US005890458A

United States Patent [19]

Kim

[11] Patent Number: 5,890,458

[45] Date of Patent: Apr. 6, 1999

[54] MULTISTEP WATER HEATER HAVING A DEVICE FOR INCREASING COMBUSTION EFFICIENCY

[76] Inventor: Sang Kyeong Kim, 330-280 Hongjae-1 dong, Seodaemun-ku, Seoul 120-091, Rep. of Korea

[21] Appl. No.: 894,025

[22] PCT Filed: Feb. 23, 1995

[86] PCT No.: PCT/KR95/00014

§ 371 Date: Aug. 11, 1997

§ 102(e) Date: Aug. 11, 1997

[87] PCT Pub. No.: WO96/26396

PCT Pub. Date: Aug. 29, 1996

[51] Int. Cl.[6] ..... F22B 23/06

[52] U.S. Cl. ..... 122/367.3; 165/154

[58] Field of Search ..... 122/367.1, 367.2, 122/367.3, 13.1; 165/154; 432/175

[56] References Cited

U.S. PATENT DOCUMENTS 4,282,833 8/1981 Giesen ..... 122/367.3

4,285,666 8/1981 Burton et al. ..... 431/347

4,385,501 5/1983 Ziegler ..... 165/154

FOREIGN PATENT DOCUMENTS 3413968 10/1985 Germany .

*Primary Examiner*—Teresa Walberg

*Assistant Examiner*—Gregory A. Wilson

*Attorney, Agent, or Firm*—Finnegan, Henderson, Farabow, Garrett, & Dunner, L.L.P.

[57] ABSTRACT

A water heater comprises a body portion; a plurality of heat transfer panels which are comprising the wall and the inner partition of the body portion and connected to each other through a water pipe; heat insulation plates which connect the heat transfer panels to each other in top end and bottom end thereof, and guide the flow of the combustion gas; and a combustion increasing plate which is installed between both heat transfer panels positioned at the center of the body portion and connected with the fuel combustion port, whereby the spaces among the heat transfer panels and the heat insulation plates serves as a flue.

14 Claims, 4 Drawing Sheets

MULTISTEP WATER HEATER HAVING A DEVICE FOR INCREASING COMBUSTION EFFICIENCY

BACKGROUND OF THE INVENTION

This invention relates to a water heater using light oil, heavy oil and liquid fuel like LNG and LPG as fuel, particularly a multistep water heater which has high combustion efficiency and improved space for fuel combustion and heat transfer surface in the water heater so that the harmful component in the exhaustion gas is reduced and the heat transfer efficiency is increased.

Generally, in most conventional water heaters such as a boiler it cannot be expected that the fuel be completely combusted. Since the conventional water heater has a small heat transfer surface, a small heat transfer region and a short heat transfer time, it also cannot be expected that the high temperature of the combustion gas from the water heater can be fully used. Therefore the high temperature of 200° C.–350° C. is directly exhausted to the atmosphere and the loss of the heat is high.

Furthermore, as the boiler using the lighter oil, heavy oil or gas as fuel is increased, the problems of environment sanitation caused by the harmful component contained in the exhaustion gas are increased.

SUMMARY OF THE INVENTION

The principle object of the invention is to provide a multistep water heater having a means for increasing the combustion efficiency of fuel, which is installed in a flue tube and leads to the complete combustion of the fuel.

It is the other object of the invention to provide a multistep water heater having a plurality of the heat transfer plates in which a water jacket is provided and water guide pins are vertically and alternatively fixed on the top end and the bottom end of the wall so that the total heat transfer surface is increased and the heater transfer efficiency becomes high.

To accomplish the above objects the present invention includes: a means for increasing the combustion efficiency of fuel which is composed of the steel plate having a number of holes pierced, the steel plate is curved in multistep and installed in a flue tube of the water heater; and a plurality of heat transfer panels composed of an inner wall, an outer wall and a water jacket between the inner wall and the outer.

A plurality of water guide pins are vertically installed in the water jacket of the heat transfer plate. The ends of the water guide pins are alternatively fixed to the top of the water jacket or the bottom of the water jacket. The other end of the water guide pins are alternatively opened between the top or the bottom of the water jacket so that the opening portion between the other end of the water guide pin and the top or the bottom of the water jacket become a passage way of water in the heat transfer panels.

A plurality of the heat transfer panels are arranged in the shell of the water heater in opposite directions about a central flue with a same space. The heat transfer panels are connected by a water pipe with each other so that the water in the panels can flow from one heat transfer panel to other heat panel continuously. Water to be heated is supplied to the heat transfer panels through a water supply pipe, and the heated water is exhausted through a water outlet pipe. The water supply pipe and the water outlet pipe are connected with the heat transfer panel which is positioned in the left and right outer heat transfer panels respectively.

DETAILED DESCRIPTION OF THE PREFERRED EMBODIMENTS

Figure 1:
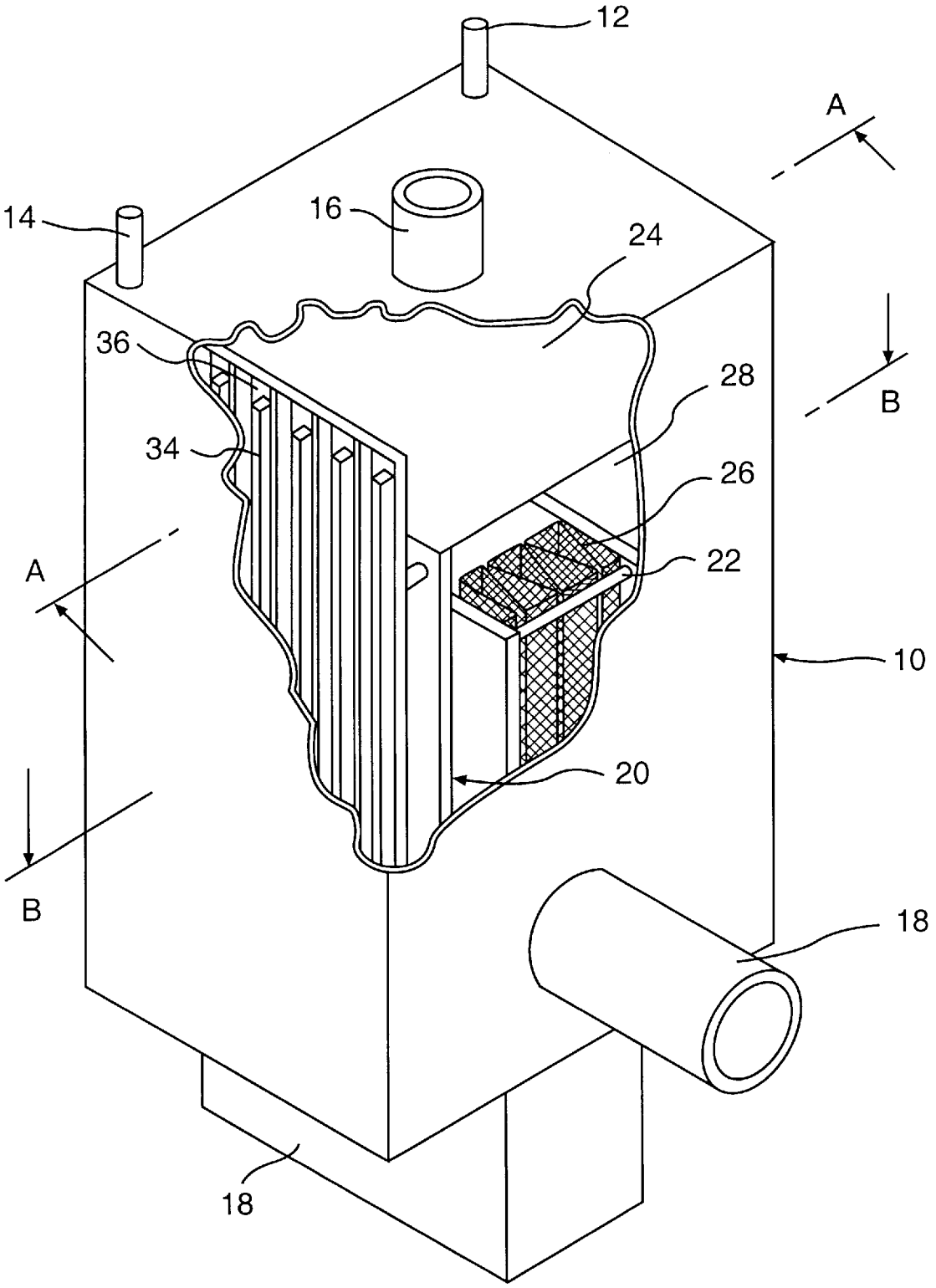
FIG. 1 is a perspective view of the water heater according to the present invention, a part of which is broken away to show the inner construction of the water heater.
Figure 2:
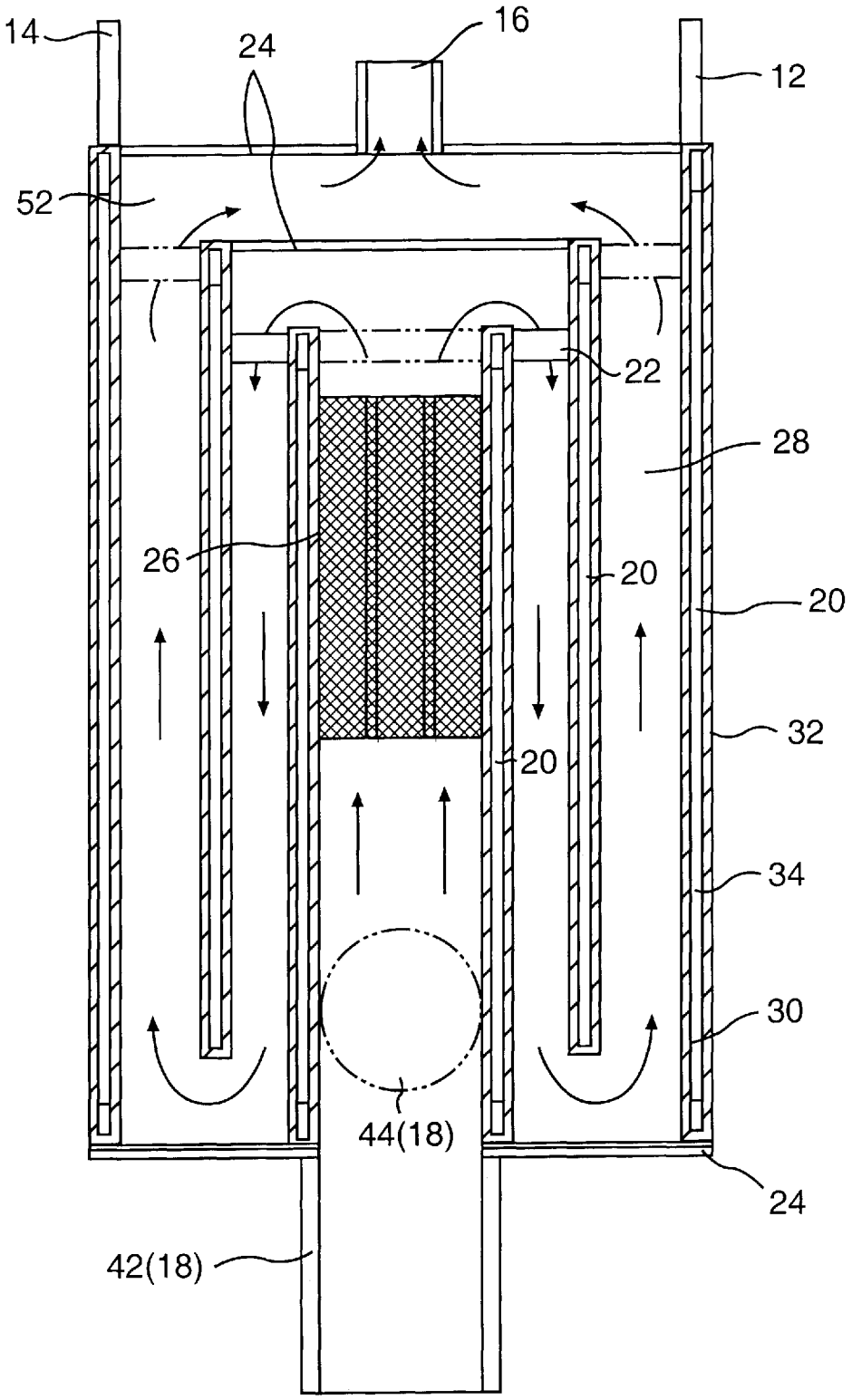
FIG. 2 is a section view along the line A—A in FIG. 1.
Figure 3:
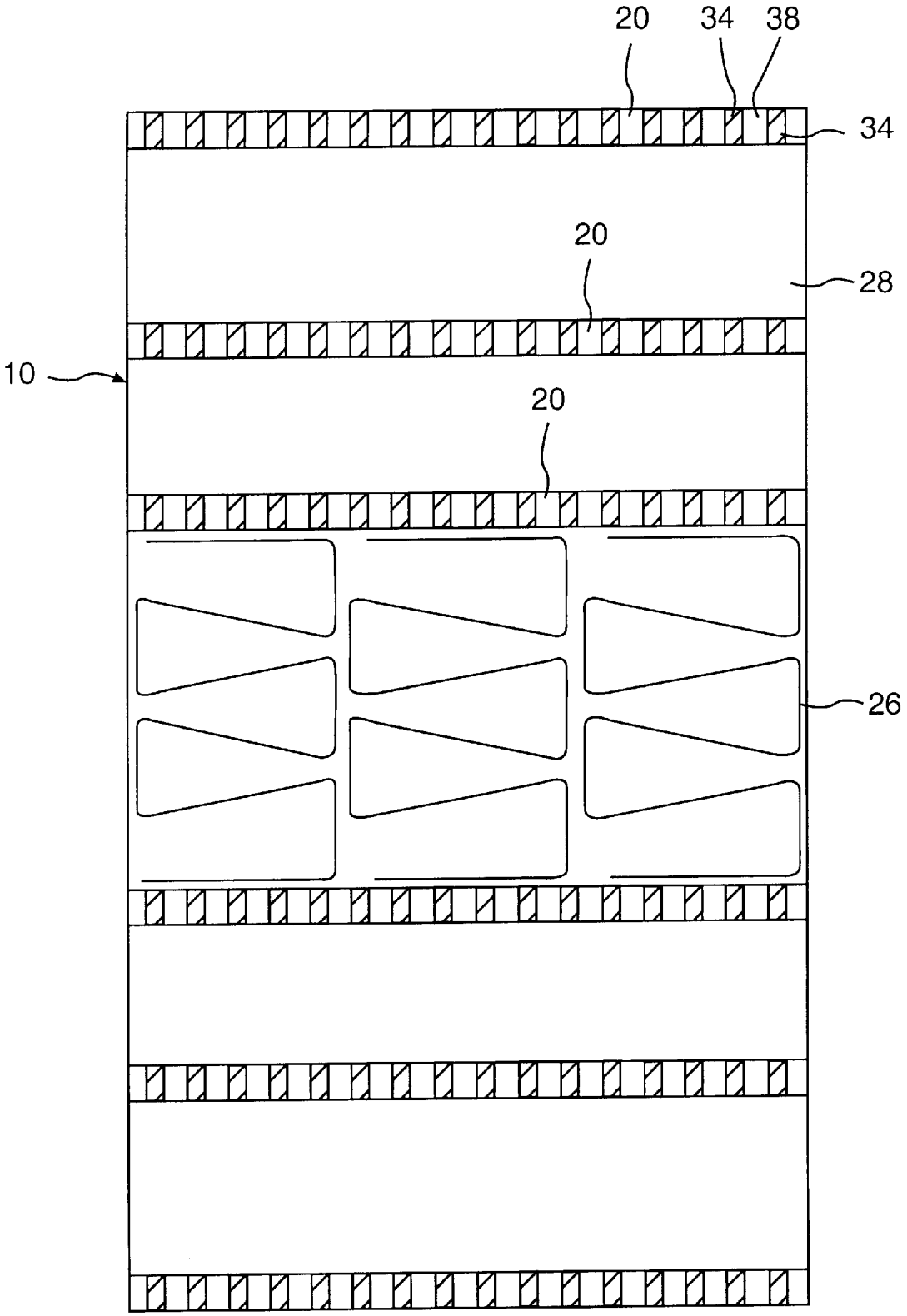
FIG. 3 is a section view along the line B—B in FIG. 1.

FIG. 1 schematically shows the inner construction of a water heater according to the present invention, the water heater comprises a body portion 10 including a water supply pipe 12, a water outlet pipe 14, a combustion gas outlet port 16, and a fuel combustion port 18 in its lower part; a plurality of heat transfer panels 20 which are comprising the wall and the inner partition of the body portion 10 and connected to each other through a water pipe 22; heat insulation plates 24 which connect the heat transfer panels to each other in the top end and bottom end thereof, and guide the flow of the combustion gas; and a combustion increasing plate 26 which is installed between both heat transfer panels 20 positioned in the center of the body portion 10 and connected with the fuel combustion port 18, whereby the spaces 28 among the heat transfer panels 20 and the heat insulation plates 24 serves as flue so that the combustion gas is exhausted from the fuel combustion port 18 to the gas outlet port 16 through the combustion increasing plate 26 and the flue 28.

The heat transfer panel 20 is comprised of an inner wall 30, an outer wall 32, and a number of water guide pins 34 vertically installed with some interval in the space between the inner wall 30 and the outer wall 32. The length of the water guide pins 34 are shorter than that of the inner and outer walls 30, 32 so that a horizontal water passage 36 is made between the end of the water guide pin 34 and the top or the bottom of the heat transfer plate 20, when one end of the water guide pins 34 are alternatively fixed on the top or the bottom of the heat transfer panel 20.

The supplied water into the heat transfer panel 20 is moved along a vertical water passage 38 between both water guide pins 34, and go over the next vertical water passage 38 through the horizontal water passage 36.

The combustion increasing plate 26 is made of metal net which is continuously multi-bent at constant depth and width. The width of the opening portion in the plate 26 is longer than that of the closed portion.

FIG. 1 shows the inner construction of the water heater equipped with the combustion increasing plate 26 according to the present invention. The body portion 10 of the water heater is composed of several heat transfer panels 20 and several heat insulation plate 24 with resistance against fire and heat. The heat transfer panels 20 are vertically arranged and connected through the heat insulation plate 24 at the top or the bottom of the heat transfer panels 20 alternatively. The volume of the water heater is determined according to the number of the heat transfer panel arranged in the body portion 10.

Furthermore, the heat insulation plate 24 is comprised of a heat reflection material installed inside thereof and a heat insulation material installed outside thereof. The heat insulation plate 24 prevents the water heater from heat loss and heat transfer from the atmosphere. When mounting the heat insulation plate 24, it is preferred that the heat reflection material side is toward the inside of the body portion 10 to increase heat efficiency of the water heater.

On the top of the heat insulation plate 24 are mounted the water supply pipe 12, the water outlet pipe 14 and the gas outlet port 16 respectively. The water supply pipe 12 and the water outlet pipe 14 are connected with the outmost heat transfer panels 20 on the right and left side respectively.

On the lowest heat insulation plate 24 mounted is mounted the fuel combustion port 18 which introduce heat from combustion of fuel into the water heater. The fuel combustion port 18 is comprised of a vertical part 42 and a horizontal part 44. The vertical part 42 of the fuel combustion port 18 is connected with a flue 28 formed between both heat transfer panel 20 located inner side of the body portion 10, the horizontal part 44 of the fuel combustion port 18 is connected with a burner (not shown).

Particularly, the fuel combustion port 18 is bellows type, that is, the length of port 18 is extended or shortened if necessary. The ratio of the size between the fuel combustion port 18 and the gas outlet port 16 is 1:4–1:5, so heat generated by combustion of fuel can not be easily extruded and the largest heat transfer efficiency can be attained. The more the length of the port 18 is extended, the higher heat transfer efficiency is.

The heat transfer panel 20 is properly arranged about the center line of the body portion 10 in symmetry. The length of the heat transfer panel 20 arranged in the inner side of the body portion 10 is shorter than that of the heat transfer panel 20 forming the shell of the body portion 10. Therefore, a space 52 is formed between the heat insulation plate 24 which connects the outmost heat transfer panels 20 forming the shell of the body portion 10 and the heat insulation plate 24 which connects the inner heat transfer panels 20. The heat transfer panels 20 are vertically arranged at identical intervals, so the combustion gas flows through flue 28 formed between the heat transfer panels 20 and through the space 42 to gas outlet port 16.

Since the interval between the heat transfer panels 20, that is, the width of the flue 28 is one third of the width of the fuel combustion port 18, the velocity of the gas can be maintained at it optimal condition.

The heat transfer panels 20 are connected with each other by the heat insulation plate 24 at the top or the bottom of the heat transfer panel 20 so that the burnt gas is continuously flowed from the center flue 26 to the side flue and finally extruded through the space 42 to the gas outlet port 16. The number of heat transfer panels 20 used in a water heater is determined according to the capacity of the water heater.

The number of heat transfer panels 20 arranged on one side from the center line of the water heater is an odd number so that the final side flue 28 is toward the space 52 located on the top of the water heater.

According to the above arrangement of heat transfer panels, the flow of the burnt gas is turned at an angle of 180 degree and the flow is vertically downward or upward. Therefore since the area receiving heat can be increased, the heat transfer efficiency is to be increased.

A means for oscillating movement and a means for ionization are mounted on the heat insulation plate 24 connecting the outer heat transfer panels comprising the shell of the water heater. The oscillating means endows vibration movement to the heat insulation plate 24.

As illustrated above, in the heat transfer panel 20 a plurality of the water guide pins 34 are vertically installed with same interval along the width of the heat transfer panel 20, the space between both water guide pins 34 become the vertical water passage 38 in which the heated water flows continuously.

The water guide pins 34 are alternatively fixed to the top end or the bottom end of the heat transfer panel 20 so that the horizontal water passage 36 is alternatively formed between the end of the water guide pins 34 and the end of the heat transfer panel 20. Therefore the inner side of the heat transfer panel 20 is thoroughly communicated through the horizontal water passage 36. Water to be heated flows along the vertical water passage 38 and turns at the horizontal water passage 36. The heated water in the heat transfer panel 20 flows through the output port which is connected with the water tube 22.

In another embodiment of the arrangement of the water guide pin 34 according to the present invention, the water guide pin 34 can be horizontally arranged. This embodiment of the water passage is formed along the width of the heat transfer panel 20.

The water passage in the heat transfer panel can give a resistance force against the flow of the water to be heated. However, since the flow of water in the heat transfer panel 20 is forcibly circulated by a pump etc, the resistance force can be ignored. Therefore water in the heat transfer panel is fully heated while water is circulated along the horizontal water passage 36 and the vertical water passage 38.

The heat transfer panel 20 comprising the shell of the body portion 10 and the heat transfer panel 20 comprising the inner partition of the body portion 10 are connected to each other through the water pipe 22, the water pipe 22 is arranged across the flue 28. The connection of the water pipe 22 is selectively accomplished at the lower portion or the upper portion of the heat transfer panel 20 according to the arranged position of the heat transfer panel 20.

The thickness of the heat transfer panel 20 is preferably 6 mm–10 mm in case the water heater is used as a small scale for domestic water heater. For large scale, some of the heat transfer panels 20 are additionally installed in the body portion 10, and it is preferred that the water pipe 22 connecting between the heat transfer panels 20 is an elliptical shape.

Figure 4:
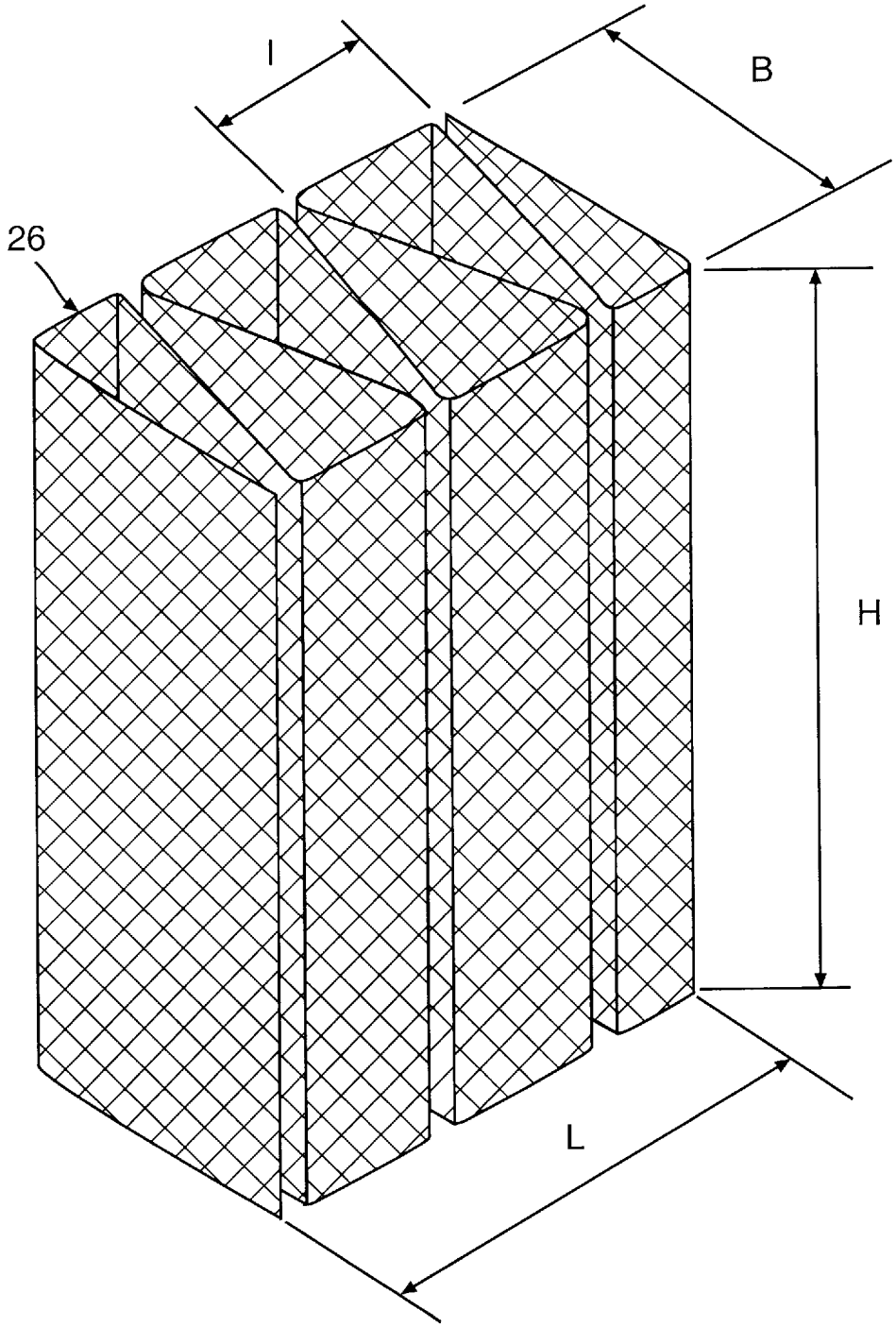
FIG. 4 is a perspective view of a combustion increasing plate according to the present invention.

The combustion increasing plate 26 which is installed in the flue connected with the fuel combustion port 18 and directly touch with the flame and the burnt gas is, as shown in FIG. 4, composed of a rectangular metal net. The metal net is continuously bent, the depth and the width of the bending portion of the metal net is constant, and the whole shape of the plate 26 is to be a right hexahedron so that the combustion increasing plate 26 can be tightly inserted into the center flue 28 communicated with the fuel combustion port 18.

The width of the closed portion of the plate 26 is wider than that of the opened portion of the plate 26, the bending shape of the plate 26 is continuously narrowed from the closed portion to the opened portion.

The combustion plate 26 has an elasticity itself along the bending direction. The length L of the plate 26 is determined to be longer than that of the width of the flue 28 so that the plate 26 is tightly inserted into the center flue 28.

Furthermore, the height H, the length L and the width B of the combustion increasing plate 26 is determined according to the length of the fuel combustion port 18. Particularly the width B of the plate 26 is constant at 30–50 mm without the relation to the length of the fuel combustion port 18, because the burnt gas is to be completely burned.

The height H, and the length L are increased or decreased at the same rate as that of increasing or decreasing the length and the width of the fuel combustion port 18. Generally since the length of the fuel combustion port 18 is long, a number of the combustion increasing plates are installed in the fuel combustion port 18.

The ratio of the interval l and the width B of the plate 26 is preferably 1:2 in order to accomplish the complete burning.

The metal net comprising the plate 26 is made of stainless steel which has high fire and corrosion resistance, high elasticity under high temperature, and has 60–80 mesh in closed packed degree.

The heat transfer panel comprising the body portion of the water heater is made of aluminum alloy, a heat insulation layer is covered around the water heater in order to reduce the loss of heat and prevent the burnt gas from leakage.

According to the construction of the present invention, water to be heated is supplied into the heat transfer panel through the water supply pipe 12, the supplied water is circulated along the horizontal and vertical water passage 36, 38 in the heat transfer panel 20 and heated to a certain temperature. The heated water is continuously moved to the next heat transfer panel 20 and gradually heated. The finally heated water is extruded through the outlet pipe 14.

On circulation of the water in the heat transfer panel 20, the heat insulation plate 24 is vibrated by the oscillating means and the scale contained in water is not deposited inside the surface of the heat transfer panel 20.

A burner equipped on the fuel combustion port 18 is a gas burner or oil burner according to the kind of the fuel used in the water heater. The gas burner is installed along the longitudinal direction, while the oil burner is installed along the transversal direction in order that the fuel and the air are fully mixed at best mode, and the shape of the flame is to be letter "L" so that the burning of the fuel is promoted.

The combustion increasing plate 26 promotes the flame and the incomplete burnt gas to be fully burnt. The flame and the incomplete burnt gas is fully mixed with the air during the flame and the incomplete burnt gas go through the combustion increasing plate 26, because the air and the flame are hit against on the roughed surface of the plate 26.

Furthermore while the burnt gas go through the plate 26, the difference between the opening portion and the closed portion of the plate 26 occurs the vortex flow to the flame and the incomplete burnt gas. As the result a particle contained in the flame etc. is broken away to the smaller particle and the smaller particle is burnt at best condition.

Finally the completely burnt gas is extruded into the atmosphere through the space 52 and the flue 28.

Therefore, the water heater according to the present invention can prevent the harmful component in the extruded gas, and the heat efficiency is increased.

What is claimed is:

1. In a water heater having a body including outer side walls vertical inner partitions, a water supply port, a water outlet port, a fuel combustion port and a combustion gas outlet port, a heat transfer panel through which water circulates and a flue in which combustion gas flows along the heat transfer panel, the improvement comprising:

plurality of said heat transfer panels (20) which constitute said outer side walls of the body (10) and said vertical inner partitions, the outer side wall heat transfer panels and the vertical inner partition heat transfer panels are connected to each other via a water tube (22);

heat insulation plates (24) selectively provided in an air tight manner on the top and bottom portion of the heat transfer panels (20) to guide the flow of combustion gas among the heat transfer panels and to form said flue in a zig-zag shape; and a combustion increasing plate (26) provided between and adjacent to two of the vertical inner partition heat transfer panels positioned at the center portion of the body and above the fuel combustion port, and composed of a rectangular metal net having a continuous bent form and a pre-determined depth and width of the bending portion to form a triangle shaped cross section in each width of the bending portion.

2. In a water heater having a body including outer side walls, vertical inner partitions, a water supply port, a water outlet port, a combustion inlet port and a combustion gas outlet port, a heat transfer panel through which water circulates and a flue in which combustion gas flows along the heat transfer panel, the improvement comprising:

the outer side walls of the body and the vertical inner partitions constituting heat transfer panels and being interconnected by water tubes to define a sinuous water flow path between the water supply port and the water outlet port;

heat insulation plates connecting in an air tight manner on the top and bottom portions of cooperating pairs of heat transfer panels to define a sinuous path for combustion gas among the heat transfer panels from the combustion inlet port and the combustion gas outlet port; and a combustion increasing plate disposed between the two innermost vertical partition heat transfer panels proximate the combustion inlet port, the combustion increasing plate composed of a rectangular metal net having a continuous bent form and a pre-determined depth and width of the bent portion to form a triangle shaped cross section in each width of the bent portion;

wherein each said heat transfer panel is comprised of an inner wall, an outer wall, and a number of water guide pins vertically installed with some interval in the space between the inner wall and the outer wall, the length of the water guide pins being shorter than that of the inner and outer walls so that a horizontal water passage is made between the end of the water guide pin and the top or the bottom of the heat transfer plate.

3. The water heater according to claim 1, wherein the ratio of the size between the fuel combustion port and the gas outlet port is 4:1 and 5:1.

4. The water heater according to claim 1, wherein the width ratio between the heat transfer panels (20) and the fuel combustion port is 1:3.

5. The water heater according to claim 1, wherein a means for oscillating movement is mounted on the heat insulation plate connecting the outer heat transfer panels comprising the shell of the water heater, the oscillating means endows vibration movement to the heat insulation plate in order not to deposit scale on the inside surface of the heat transfer panel.

6. The water heater according to claim 1, wherein the combustion increasing plate is made of stainless steel.

7. The water heater according to claim 6, wherein the combustion increasing plate (20) has 60–80 meshes in populous degree.

8. The water heater according to claim 7, wherein the width of the combustion increasing plate is 30–50 mm, and the interval of bending is one half of the width.

9. The water heater according to claim 2, wherein the ratio of the size between the combustion inlet port (18) and the gas outlet port (16) is between 4:1 and 5:1.

10. The water heater according to claim 2, wherein the width ratio between the heat transfer panels (20) and the combustion inlet port (18) is 1:3.

11. The water heater according to claim 2, wherein a means for oscillating movement is mounted on the heat insulation plate connecting the outer heat transfer panels comprising the shell of the water heater, the oscillating means endows vibration movement to the heat insulation plate in order not to deposit scale on the inside surface of the heat transfer panel.

12. The water heater according to claim 2, wherein the combustion increasing plate is made of stainless steel.

13. The water heater according to claim 12, wherein the combustion increasing plate has 60–80 meshes in populous degree.

14. The water heater according to claim 13, wherein the width of the combustion increasing plate is 30–50 mm, and the interval of bending is one half of the width.

* * * * *